United States Patent [19]

Murat

[11] 4,049,107

[45] Sept. 20, 1977

[54] PRINTING DEVICES OR HEADS FOR PRINTERS OR THE LIKE AND A PROCESS FOR MAKING SUCH A PRINTING HEAD

[75] Inventor: Roger Murat, Argenteuil, France

[73] Assignee: Societe d'Applications Generales d'Electricite et de Mecanique SAGEM, Paris, France

[21] Appl. No.: 619,321

[22] Filed: Oct. 3, 1975

[30] Foreign Application Priority Data

Oct. 8, 1974 France ..... 74.33837

[51] Int. Cl.[2] ..... B41J 3/04

[52] U.S. Cl. ..... 197/1 R; 101/93.05; 335/273

[58] Field of Search ..... 197/1 R; 101/93.04, 101/93.05; 335/250, 273

[56] References Cited

U.S. PATENT DOCUMENTS

| | | | |
|---|---|---|---|
| 3,584,575 | 6/1971 | Distl | 197/1 R X |
| 3,820,643 | 6/1974 | Priebs et al. | 197/1 R |
| 3,828,908 | 8/1974 | Schneider | 197/1 R |
| 3,842,955 | 10/1974 | Iwasaki | 197/1 R |
| 3,889,793 | 6/1975 | Cattaned | 197/1 R |
| 3,896,918 | 7/1975 | Schneider | 197/1 R |
| 3,929,214 | 12/1975 | Hebert | 197/1 R |

FOREIGN PATENT DOCUMENTS

| | | | |
|---|---|---|---|
| 2,119,641 | 11/1972 | Germany | 197/1 R |
| 2,057,961 | 6/1971 | Germany | 197/1 R |

*Primary Examiner*—Ralph T. Rader

*Attorney, Agent, or Firm*—Cushman, Darby & Cushman

[57] ABSTRACT

The invention concerns a printing device or head for a printer or the like and to a process of making same. The device comprises a plurality of needles each having an electro-magnet and a metal plate associated therewith, a selected needle being displaceable against an information support upon energization of the associated electro-magnet. The electro-magnets are supported in a base. In accordance with the invention each electro-magnet includes a U-shaped magnetic circuit, the base including housings for magnetic circuits. A surrounding, insulating material is disposed between the arms of the magnetic circuit and around the windings of the electro-magnets.

8 Claims, 2 Drawing Figures

Figure 2:
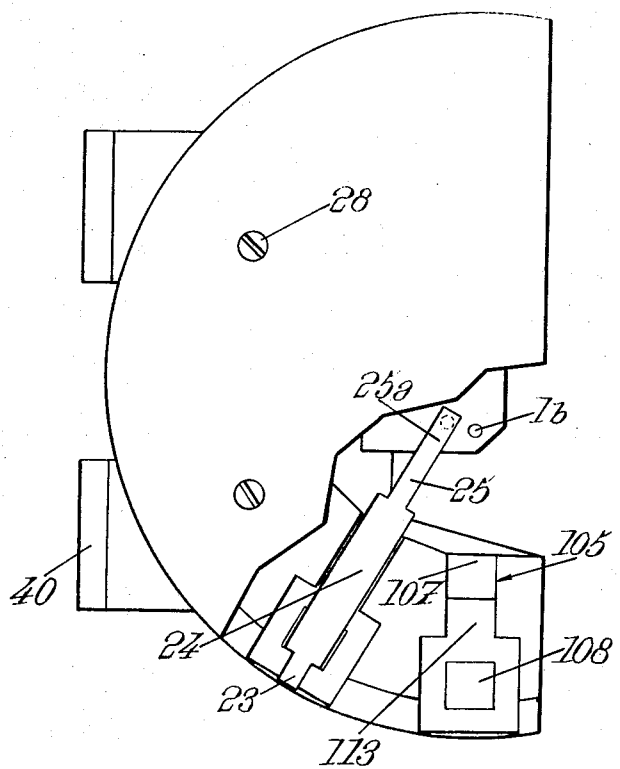

PRINTING DEVICES OR HEADS FOR PRINTERS OR THE LIKE AND A PROCESS FOR MAKING SUCH A PRINTING HEAD

The present invention relates to improvements in a printing device or head for a printer or the like. The invention also relates to a process for the manufacture of a printing head of the aforesaid kind.

Known printing devices or heads of the kind with which the invention is concerned comprise an assembly of needles one end of which are intended to strike an information support and mark thereon selected points representative of figures, characters or the like, an electro-magnet and a metal plate being associated with each needle co-operating in a manner to displace said plate when a signal is applied across the winding of the corresponding electro-magnet, the displacement being such as to cause the projection of the associated needle towards said support, the electro-magnets being supported in a base.

In known devices of this kind, the connection between the base and the electro-magnets is effected with the aid of screw type means. Moreover, in these known devices, there is provided an assembly, which is difficult to produce, to permit pivoting of the plates. Such devices are difficult to assemble and, in general, require individual adjustment of each electro-magnet. In other known devices, the base forms a single piece with the magnetic circuits of the electro-magnets and these devices are complex and of considerable weight.

The invention has for an object to remedy the above mentioned disadvantages and thus to provide a printing head of particularly simple and economic construction.

A further object of the invention is to provide a head of this kind which is of reduced size and weight. Other objects and advantages of the invention will follow from the description taken with respect to the drawings.

In accordance with the invention there is provided a printing device or head of the kind described wherein each electro-magnet comprises a substantially U-shaped magnetic circuit around an arm of which is disposed a corresponding winding and wherein the base comprises housings for said magnetic circuits. In the device or head according to the invention there is disposed a surrounding material, preferably an insulating material, around each winding and in such a manner as to be in contact with a part of the base. The surrounding material is such as to adhere to the materials which constitute respectively the magnetic circuit and the base.

The term "housing" in the base should be interpreted herein as complementary fixing means provided in the base and in each magnetic circuit.

In one embodiment of the invention, a retention element for the plates is disposed in such a manner that the plates are between the corresponding magnetic circuits and the said retaining element, the plates including a first and a second lateral face in which are formed lateral guide notches for the plates.

In order to produce the printing device according to the invention, the following procedure is advantageously followed:

During the first stage of this process the magnetic circuits provided with their windings are disposed on the base; during the second stage a hardenable insulating material is poured between the arms of each U-shaped magnetic circuit, around each winding and externally of at least one arm of each U so that the hardenable material is in contact with the base. Preferably, after having fixed the U-shaped magnetic circuits on the base, all the free ends of the arms of the said magnetic circuits are aligned.

Figure 1:
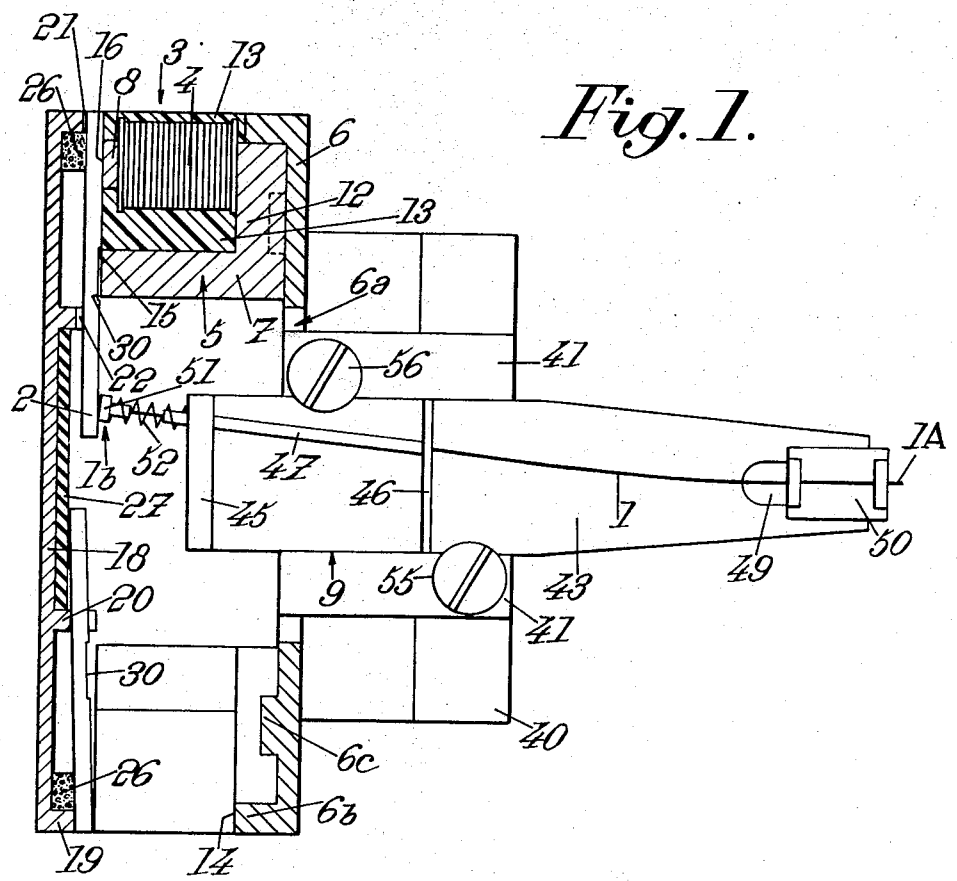

The invention will now be described further by way of example with reference to the accompanying drawings in which:

FIG. 1 illustrates, partly in section, a printing head according to a preferred embodiment of the invention, and FIG. 2 is a plan view, partly broken away, of the device shown in FIG. 1.

The printing head which is illustrated in FIGS. 1 and 2 comprises, in known manner, an assembly of needles 1 the ends 1*a* of which are intended to strike an information support (not shown). For ease of drawing, only a single needle 1 has been shown in FIG. 1. The information support referred to above is normally of paper in which case an inking ribbon (not shown) is, in general, disposed between the ends 1*a* of the needles and the support. Seven, eight or nine needles are used and the ends 1*a* of the needles are preferably disposed in a straight vertical line.

When a needle strikes the inking ribbon it marks a point on the information support paper. As is well known, in order to print a character or figure by means of the needles 1, a certain number of determined points in a matrix of points of given form are selected with the aid of memory means (not shown). This matrix can include a variable number of points according to the number of lines and columns, for example 35 points arranged in 7 lines and 5 columns, 45 points in 5 lines and 9 columns, 63 points ($7 \times 9$) or 81 points ($9 \times 9$). The projection of the needles 1 onto the support is obtained by the displacement of plates 2 which act on the other ends 1*b* of the needles 1. The plates 2 co-operate with electro-magnets 3 having windings 4. When a signal is applied across a winding 4 the associated plate is displaced so as to drive the corresponding needle 1 to project it against the information support.

According to the invention, the windings 4 are wound around magnetic circuits 5 which are associated with each needle 1, a plate 2 and an electro-magnet 3 comprising a winding 4 and a magnetic circuit 5; the magnetic circuits associated with the different needles form separate parts. Since, in the example, seven needles 1 are provided, the device or head of the invention thus includes seven magnetic circuits 5.

The magnetic circuits 5 are all fixed in the same base 6.

It will immediately be noticed that such an arrangement, which consists in providing separate magnetic circuits and a base to unite and position all these magnetic circuits one with respect to the other is particularly advantageous because it produces a printing device or head which is simple to manufacture. Moreover, the base 6 can be made from a light-weight material such as aluminium or plastics material to enable the weight and cost of the head to be reduced.

The cost is further reduced if all the circuits 5 are of identical form and dimensions and are made from the same material, since the magnetic circuits 5 can then be mass produced.

All the magnetic circuits 5 are of U-shape, the arms of the U being designated 7 and 8. As can be seen in the magnetic circuit 105 of FIG. 2, the section of each arm 107 and 108 is square. In another advantageous arrangement of the invention, the base 6 is generally in the form of a semi-circular ring and the magnetic circuits distributed uniformly thereon. The median plane of the arms of each U-shaped magnetic circuit is a radial plane passing through the axis of the half ring constituted by the base 6. The ends 1*b* of the needles 1 are also arranged in a semi-circle. The needles 1 and their support 9 extend through the central opening 6*a* of the base.

This semi-circular arrangement of the magnetic circuits is particularly advantageous because it permits a minimal deformation of the needles 1 to cause them to converge along a straight line at the level of their ends 1*a*.

The ring 6 comprises a lateral external wall 6*b* of cylindrical shape. Moreover, a rib 6*c*, also in the form of a ring having the same axis as the base 6, extends beyond a face of the base 6 between the wall 6*b* and the opening 6*a*.

Radial grooves are formed in the rib 6*c*. The base of each U-shaped magnetic circuit 5 is held in such a groove. Moreover, the external face of the base 12 of the magnetic circuit 5 which is at the level of the arm 8 is applied against the internal face of the wall 6*b*. Thus, each magnetic circuit 5 has a well determined angular and radial position.

In order to fix the magnetic circuits 5 with respect to the base 6, the following procedure is followed: After having installed the magnetic circuits 5 provided with their windings 4 in their housings on the base 6, a thermoplastics material 13 is poured between the arms of each U and around each winding 4. The thermoplastics material 8 is poured moreover in such a manner as to be in contact with the portion 14 of the wall 6*b*. This operation of introducing thermoplastics material is effected in a mould (not shown) in such a manner that the external limit of the thermoplastics material lies in the extension of the external wall 6*b* and in the plane of the upper faces 15 and 16 of the respective arms 7 and 8. Thus, the thermoplastics material 13 constitutes, on the one hand, a protective sheath for the windings 4 and, on the other hand, fixes the circuits 5 with respect to the base 6.

After pouring plastics material around the windings 4, the free ends 15 and 16 of the arms 7 and 8 of all the magnetic circuits are aligned.

In another arrangement of the invention, retention means for the plates are provided which are particularly simple. The retention means comprise, in the example, a cover 18 having the form of a semi-circular flat plate. Lateral edges of this plate 18 form a projecting cylindrical wall 19. A cylindrical ring 20 also projects from the plate 18 at the same side as the wall 19. The cylindrical walls 19 and 20 both have the same axis which is, when the printing head is finally mounted, the same as that of the base 6. Moreover, the external diameter of the cylindrical wall 19 is equal to the external diameter of the cylindrical wall 6*b* of the base 6. Finally, the greatest diameter of the wall 20 is less than the diameter of the line (imaginary) on which are arranged the external lateral walls of the arms 7 of the magnetic circuits 5.

Notches 21 and 22 respectively are formed in the walls 19 and 20. These notches are disposed at the level of the median plane of the location of the magnetic circuits 5. More precisely, with each notch 21 corresponds a notch 22 of the wall 20 which lies on the same radial line.

In the example, the notches 21 and 22 all have the same width and are intended to serve for the longitudinal guiding and retention of the plates 2. In effect, each plate comprises three parts. The rear part 23 (FIG. 2) of each plate is of relatively narrow width and is intended to be disposed in the notches 21. The central part 24 of each plate is of greater width than the rear part 23 and is normally located between the walls 19 and 20. Finally, the forward part 25 has substantially the same width as the rear part 22 but its length is greater. It is the end 25*a* of this forward part of each plate 2 which is intended to project the needles 1 against the support.

A first ring 26 of resilient material, in the example foam rubber, is glued on the internal wall of the plate 18 in the region of the wall 19. Another plate of resilient material 27 also covers the plate 18 within the semicylinder formed by the wall 20.

Fixing means permit the plate 18 to be fixed with respect to the base 6. The fixing means consists of screws 28 which extend through openings (not shown) in the plate 18 so as to be able to engage in threaded holes (not shown) in the base 6.

Each plate includes an air gap 30 at the level of the internal arms 7 of the magnetic circuits 5. This gap extends over a length slightly greater than the width of the corresponding arm 7. Thus, when a signal is applied across a winding 4, the plate 2 is attracted towards the walls 7 and 8. The plate is then blocked against the wall 8 and bears also against the plastics material 13; however, this plate 2 is not in contact with the face 15 of the arm 7.

It has been seen that this latter arrangement permits the use of the printing head of the invention for printing information at considerable speed.

In the embodiment of the invention which is shown in the drawings, the base 6 is fixed to a part 40 intended to ensure fixing of the head to driving means — permitting the displacement of the head with respect to an information support — such as the rod of a carriage. In the latter case, the part 40 includes a cylindrical opening having an axis parallel to the plane of the base 6. Moreover, the base 6 is rigid with an element 41 for retaining and guiding the needle support 9. The part 40 and the element 41 form a single piece with the base 6. The element 41 has a central recess of rectangular section which is intended to support and guide the support 9.

The support 9 comprises a flat elongated plate 43 of which a part is located in the central recess of the element 41. Two walls 45 and 46 project from this plate 43 and lie perpendicular to the plate 43. The walls 45 and 46 are thus in planes substantially parallel to the plane of the plate of the base 6 and of the retention plate 18.

Between the walls 45 and 46 are disposed guide tubes 47 for the needles 1. For clarity in the drawing, only a single tube 47 has been shown; the number of these tubes is, of course, equal to the number of needles. The tubes 47 are passed through corresponding openings in the walls 45 and 46.

At the forward end of the plate 43 is formed a groove 49 which permits the fixing and positioning of a member 50 for supporting and guiding the forward ends of the needles 1. The member 50 is, in general, called a "comb" and includes guide elements for the needles made from a particularly hard material such as ruby.

The rear ends 1*b* of the needles 1 are rigid with bases 51 which permit the ends 25 of the plates to push on the needles 1 and, thus to project them onto the information support. Finally, a spring 52 is disposed between the base 51 and the wall 45. The purpose of this spring is to separate the ends 1*a* of the needles 1 from the information support when the signal applied across the winding 4 is removed.

When a signal is applied across a winding 4 the corresponding plate is attracted towards the faces 15 and 16 in a manner such as to reduce the air gaps of the magnetic circuit constituted by the magnetic circuit 5 proper and the plate 2. Thus, the end 25*a* of the corresponding plate 2 pushes on the base 51 and the needle 1*a* is projected towards the information support. When the signal is removed from across the winding 4 the spring 52 separates the end 1*a* from the information support and pushes back the end 25 of the plate 2 towards the resilient material 27. It will thus be seen that the resilient material 26 and 27 permit the damping of vibrations which could result from the operation of the printing head of the invention.

In the embodiment of the invention which is shown in the drawings it will be seen that the needle support 9 is fixed in the element 41 by means of two screws 55 and 56. The support 9 is thus removable from the remainder of the head; moreover the position of the support 9 with respect to the other elements of the printing head can easily be adjusted. It will also be noted that the position of the comb 50 can also be adjusted in simple manner. Finally the support 42 can be made, as can the base 6, in a light-weight material such as aluminium.

In one embodiment of the invention the magnetic circuits 5 are made from soft iron. In another embodiment, in which it is desired to obtain particularly high printing speeds, the magnetic circuits 5 are made from a material sold under the tradename "Vacoflux," which material does not become saturated for normal values of current flowing in the windings 4.

The printing head which has just been described has a particularly simple structure such that no adjustment of its components (electro-magnets, plates and needles) is necessary when the head is mounted in a printer.

The device or printing head of the invention can be used particularly in printers.

It will be apparent to those skilled in the art that various modifications and improvements may be resorted to without departing from the spirit and scope of the invention as defined in the following claims.

I claim:

1. In a printing device for a printer having an assembly of needles and respective control means for each of said needles one end of each needle being intended to strike an information and support and mark thereon selected points representative of figures, characters or the like, said control means comprising a metal plate and an electro-magnet for displacing said plate when a signal is applied across the winding of the electro-magnet, the displacement being such as to cause the projection of the respective needle towards said support, each electro-magnet of said control means being supported in a base, the improvement wherein each electro-magnet includes a substantially U-shaped element having arms defining a magnetic circuit, said element being separate from said base, the winding of said electro-magnet being disposed around an arm of said U-shaped element, said base having housings for supporting said magnetic circuit elements, and a surrounding material is provided to adhere to said magnetic circuit element and said base, said surrounding material encapuslating each winding and said arm supporting said winding to fix said elements and windings with respect to said base and protect said windings.

2. A device as set forth in claim 1 wherein said magnetic circuit elements all have the same shape and the same dimensions and are all made from the same magnetic material.

3. A device as set forth in claim 1 wherein said U-shaped element has arms and said surrounding material is disposed between said arms of each U-shaped magnetic circuit element.

4. A device as set forth in claim 1 wherein said base is made from light-weight aluminium.

5. A device as set forth in claim 1 wherein said magnetic circuit elements are disposed substantially in a semi-circle on said base, said base having substantially the form of a semi-circular ring.

6. A device as set forth in claim 1 which additionally comprises a retaining part each of the plates disposed in a manner such that said plates are located between the corresponding magnetic circuits and said retaining part, said retaining part including first and second lateral faces in which are formed lateral guide notches for said plates.

7. A device as set forth in claim 6 wherein damping elements are disposed between said plates and a transverse face of said retaining part.

8. A device as set forth in claim 1 which additionally comprises a needle support removable from the assembly formed by said base, said plates, and said magnetic circuits, the position of said support being adjustable with respect to said assembly.

* * * * *